United States Patent [19]

Mucha et al.

[11] Patent Number: 4,855,556

[45] **Date of Patent: * Aug. 8, 1989**

[54] METHOD AND APPARATUS FOR HARDENING GEARS AND SIMILAR WORKPIECES

[75] Inventors: George M. Mucha, Parma Heights, Ohio; Donald E. Novorsky, Pleasant Ridge; George D. Pfaffmann, Farmington, both of Mich.

[73] Assignee: Tocco, Inc., Boaz, Ala.

[ * ] Notice: The portion of the term of this patent subsequent to Jul. 12, 2005 has been disclaimed.

[21] Appl. No.: 184,588

[22] Filed: Jun. 21, 1988

Related U.S. Application Data

[63] Continuation of Ser. No. 1,624, Jan. 6, 1987, Pat. No. 4,757,170, and a continuation-in-part of Ser. No. 878,186, Jun. 25, 1986, Pat. No. 4,675,488.

[51] Int. Cl.[4] ..... H05B 6/14

[52] U.S. Cl. ..... 219/105.9; 219/10.43; 266/129; 148/147

[58] Field of Search ..... 219/10.59, 10.57, 10.41, 219/10.43, 10.71, 10.75, 10.77; 266/124, 125, 126, 129; 148/147, 148, 150, 152

[56] References Cited

U.S. PATENT DOCUMENTS

| | | | |
|---|---|---|---|
| 2,167,798 | 8/1939 | Denneen et al. | 219/10.59 X |
| 2,444,259 | 6/1948 | Jordan | 219/10.59 |
| 2,590,546 | 3/1952 | Kincaid et al. | 219/10.59 |
| 2,689,900 | 9/1954 | Redmond et al. | 219/10.75 |
| 3,446,495 | 5/1969 | Pfaffman et al. | 266/129 |
| 3,502,312 | 3/1970 | Douglass | 219/10.59 |
| 3,784,780 | 1/1974 | Laughlin et al. | 219/10.71 |
| 4,251,704 | 2/1981 | Masie et al. | 219/10.59 |
| 4,363,946 | 12/1982 | Busemann | 219/10.59 |
| 4,420,667 | 12/1983 | Lewis | 219/10.71 X |
| 4,604,510 | 8/1986 | Laughlin et al. | 219/10.43 |
| 4,757,170 | 7/1988 | Mucha et al. | 219/10.43 |
| 4,808,779 | 2/1989 | Cogley | 219/10.43 |

*Primary Examiner*—Philip H. Leung

*Attorney, Agent, or Firm*—Body, Vickers & Daniels

[57] ABSTRACT

A method and apparatus for progressively hardening an elongated workpiece having an outer generally cylindrical surface concentric with the central axis including the concept of providing closely spaced first and second induction heating coils each having workpiece receiving openings generally concentric with the axis of the workpiece; energizing the first coil with a low frequency such as a frequency less than about 50 KHz; energizing the second coil with a high radio frequency, such as the frequency exceeding 100 KHz; causing relatively axial and progressive motion between the workpiece and the first and second closely spaced coils in a direction entering the first coil and exiting the second coil whereby the cylindrical surface is progressively first preheated by the first coil and then immediately final heated by the second coil; and, then immediately quenching the cylindrical surface as it passes from the second coil whereby the cylindrical surface is progressively preheated, heated and quench hardened as the workpiece is moved through the induction heating coil.

3 Claims, 8 Drawing Sheets

METHOD AND APPARATUS FOR HARDENING GEARS AND SIMILAR WORKPIECES

This is a continuation of application Ser. No. 001,624 filed Jan. 8, 1987 (now U.S. Pat. No. 4,757,170 which issued July 12, 1988) which in turn is a continuation-in-part of Ser. No. 878,186 filed June 25, 1986 which has now issued as U.S. Pat. No. 4,675,488 on June 23, 1987.

The present invention relates to the art of induction heating and more particularly to an improved method and apparatus for hardening the outer toothed surface of a gear or similar workpieces.

Background Of Invention

The invention is particularly applicable for inductively heating and quench hardening the outer cylindrical toothed surface of an axially elongated gear and it will be described with particular reference thereto; however, the invention has broader application and may be used for inductively heating and then quench hardening other elongated workpieces having an outer cylindrical surface generally concentric with a central axis and with axially extending convolutions, such as teeth. The invention is also particularly applicable, for hardening the outer toothed surface of a gear that has a substantial axial length which would be difficult to heat effectively and economically by an encircling inductor; however, the invention is also applicable for various gears having a variety of axial lengths. The axial length is the axial height of the toothed surface which is concentric to the rotational axis of the gear. Obtaining surface hardening of the teeth without thorough hardening of the teeth presents substantial technological problems when using induction heating and subsequent quench hardening. The cold core draws away heat energy before quench hardening of the surface can occur without hardening through the teeth. Consequently, the total tooth is hardened to produce needed surface hardening when attempting to use induction heating. This has prevented use of induction heating to harden teeth even though there are theoretical advantages.

To withstand the wear and contact forces exerted during operation of a high power transmitting gear train, it is necessary to provide a hardened outer surface for the various gears constituting the gear train. In accordance with standard technology, the surfaces are hardened while the inner portion or core of the workpiece remains generally soft to present strength and ductility. For many years the surface hardness of gears has been accomplished by a carburizing process wherein the gears are first machined, then immersed in a carburizing media for a substantial length of time to infuse carbon into the surface, and then heat treated so that the carburized outer surface will have a substantially greater hardness than the inner portion or core of the gear. This type of process is lengthy and tremendously expensive. The carburization process does, however, produce gears having an inner tough unhardened mass or core with outer case hardened surfaces for the various teeth extending circumferentially around the outer periphery of the gear. Such costly carburizing processes have motivated many companies to attempt a direct adaptation of relatively inexpensive, easily controlled induction heating technology to the hardening of the outer teeth on gears. Many patents relate to attempts to accomplish this feat. Generally speaking, the only arrangement that has been at all successful has been machines which inductively heat and then quench harden only a few teeth at one time while the rest of the teeth are cooled for the purposes of preventing drawback of previously hardened teeth. By indexing the induction heating mechanism of these machines about the total circumference of the gear, all of the teeth are successively hardened. In this manner, induction hardening of the gear teeth can be accomplished; however, the inductors were extremely complex and expensive. Such induction heating processes have been unsuccessful for mass production since they require a number of heating operations for processing a single gear. Further, such processes involved relatively complex indexing mechanisms and complex induction heating coils or inductors. Pfaffmann U.S. Pat. No. 3,446,495 and Masie U.S. Pat. No. 4,251,704 illustrate the type of equipment wherein induction heating has been employed for the purpose of hardening the gear teeth on the circular periphery of a gear. These apparatus do function; however, they have the disadvantages previously described. Assignee of these two patents and other leading manufacturers of induction heating equipment have been seeking for many years an approach that can be used for inductively heating the outer peripheral surfaces of gears by using an encircling inductor so that the gears can be heated by the inductor and then quench hardened immediately thereafter to create case hardening on the outer surfaces of the gear without requiring any modification other than a certain amount of carbon in the steel itself to facilitate hardening of the outer surfaces. By developing such an induction heating concept, the time consuming, expensize carburizing process could be replaced by an apparatus for first inductively heating and then quench hardening the outer surface of the gears. A prior attempt to accomplish this goal is illustrated in Denneen U.S. Pat. No. 2,167,798 wherein a complex apparatus is provided for driving the current created by the inductor into the areas between adjacent teeth for the purposes of inductively heating and then immediately quench hardening the various gears at the same time. This process was not widely adopted and did not replace the carburizing process of gear teeth as previously described.

Immediately after the second World War, it was suggested that induction heating of the outer gear teeth could be accomplished by a dual frequency arrangement wherein a low frequency current would be used for preheating the gear teeth and then a high frequency current could be used for final heating preparatory to quench hardening. Two arrangements for applying this induction heating concept are illustrated in Jordan U.S. Pat. No. 2,444,259 and Redmond U.S. Pat. No. 2,689,900 wherein a single induction heating coil is provided with two frequencies for the purposes of accomplishing deep heating and then surface heating preparatory to quench hardening the teeth of a gear. This process was not successful. Another arrangement was suggested in Kincaid U.S. Pat. No. 2,590,546 wherein the gear is first placed in one induction heating coil driven by a relatively low audio frequency of less than about 15 KHz. Thereafter, the workpiece is shifted into another induction heating coil for heating by radio frequency. After radio frequency heating, the workpiece is shifted into a quenching ring for the purposes of quench hardening the outer heated teeth. This process has substantial merit in that relatively simple induction heating coils and quenching units can be employed for induction heating of the outer surfaces of the gear first by low frequency preheat and then by high frequency final heat to produce a skin effect for creating the hardness pattern around the gear teeth, as illustrated in FIG. 1 of Kincaid U.S. Pat. No. 2,590,546. Even though this process involves simple equipment and known technology, it has not been successfully employed for the purposes of mass producing hardened gears to absorb the stresses and forces created in high power gear trains, such as found in many heavily loaded gear drive trains such as transmissions. Even with these several suggestions on how induction heating can be employed for hardening the teeth of a gear, carburizing is still the basic and common way of accomplishing this hardening process.

Within the last few years, in view of the high price of gas, foreign competition requiring cost reduction and other market conditions, there is now a substantial, tremendous and immediate need for a successful process whereby induction heating of gear teeth can be used for the purpose of providing the gear teeth with hard, tough, high compression surfaces without causing brittle teeth or various under hardened teeth or over hardened areas between the teeth. To accomplish this objective, it is necessary and critical to produce an induction heating process wherein just before quench hardening the outer surfaces have a preselected temperature to a controlled depth whereas the material immediately behind or below the depth has a substantially lower temperature. Consequently, the quench hardening by liquid will quench harden only the outer surface to the controlled depth and not through harden the teeth. Induction heating of the gear teeth preparatory to quench hardening in the past has resulted in uneven heating and thus uneven hardness depth or pattern. Some of the surfaces have not been hardened at all, others have been hardened through the teeth and some have produced too deep or too shallow hardness at the root between the adjacent teeth. All of these nonuniformities in the hardness pattern are caused by nonuniform distribution of temperature gradients immediately before the liquid quench hardening. The liquid quenching causes rapid cooling. If the temperature is above the transformation temperature, hardening occurs. If the temperature is below the transformation temperature, no hardening or reduced hardening occurs. Further, slow cooling prevents proper hardening. At this time, there is a substantial need for an invention in the induction heating field which will create a heat distribution around the teeth of a gear immediately before liquid quench hardening which is uniform so that the resulting hardness pattern after quenching will be uniform. In addition, this induction heating process must be capable of performance at a high rate necessary to substantially reduce the cost required in hardening gear teeth over the cost involved in the processing and equipment now used for carburizing and must use easily controlled simplified inductors.

THE INVENTION OF PRIOR APPLICATION

In accordance with the present invention of the prior application, there is provided a method of hardening the radially protruding convoluted surfaces of a generally circular, toothed workpiece, such as a gear, which gear is adapted to rotate about a central axis generally concentric with the convoluted surfaces. The teeth of the gear define an outer circle which is clearly recognizable in viewing the gear from the side. The method of the invention of the prior application includes providing first and second induction heating coils having inner circular surfaces generally matching, but slightly larger than, the outer surface defined by the tips of the teeth on the gear, locating the gear or workpiece concentrically in the first induction heating coil which is then energized with a first alternating frequency current of less than about 10 KHz at a first power level greater than about 100 KW for a first time period of less than 10.0 seconds, deenergizing the first induction heating coil with the workpiece still therein for a first time delay period of at least about 10.0 seconds and, then, again, energizing this first induction heating coil with a second alternating frequency current of less than about 10 KHz and at a second power level at least as great as the first power level and for a second time period substantially less than the first time period. The band at the base or roots of the teeth is thus heated with a high energy so that a substantial current flows around this circular band at the roots of the teeth. By using low frequency, the heating depth is substantial and the current flow is caused at the lower portion of the teeth and in the roots of the teeth. This preheating process involves two separate and distinct heating operations which are generally at the same frequency, such as 3.0 KHz. The first preheating cycle, in practice, is for approximately 3.0 seconds. The time delay in the total dual cycle preheating allows the heat energy in the teeth to dissipate thereby concentrating the high temperature and energy levels within the band adjacent the roots of the teeth. The next preheating cycle is for a relatively short time of about 1.4 seconds which then heats not only the previously heated roots, but also heats the teeth to a temperature still below the Curie Point temperature. Thus, after preheating which involves a distinct intermediate delay between two high energy cycles causing the high power energy to concentrate in the roots, the gear is immediately and rapidly transferred to a second induction heating coil, which coil or inductor is immediately energized with a radio frequency current of more than about 100 KHz at a third power level still over about 100 KW for a third time period of less than about 1.0 seconds. In this manner, high energy is stored and concentrated adjacent the root portion or band of all the gear. This produces a circumferentially extending band of high energy, high temperature which is at a higher temperature than the teeth themselves and is at a temperature substantially above the temperature of the core below the root portion of the teeth. This temperature profile is very dynamic and unstable. It cannot last too long since the energy tends to conduct to the cold core and, to a lesser extent, to the warm teeth. During the radio frequency heating, which occurs for about 0.4 seconds after a shift delay of about 0.4 seconds, the radio frequency current causes a skin effect heating around the surface of the individual teeth and in the root portion between the teeth. This skin effect heating produces a thin skin or layer of high temperature metal substantially above the hardness temperature A3. Due to the high concentration of heat energy in the root portion of the teeth, the cold core which is a heat sink mass can not conduct heat from the portion of the gear between the teeth at a rate sufficient to reduce the skin heating below the A3 temperature. This skin portion stays hot. Also, the portion along the outer surface of the teeth is above the hardness temperature A3. The teeth themselves are warm and do not establish a high temperature gradient to cause rapid cooling of the teeth surfaces after the radio frequency heating. The gear is then immediately quenched by flow of liquid from the radio frequency heating coil. In practice, an integral quench coil is employed. There is not sufficient time to allow transfer of the gear with the unstable, unique temperature distribution accomplished by using the present invention. Integral quench occurs immediately after the radio frequency has stopped. Indeed, it can occur while the radio frequency is operating for the purposes of avoiding a time when there is a tremendous conduction inertia caused by temperature differentials or gradients for the purpose of drawing the energy from the outer surface into the teeth to cause reduced temperatures before quench hardening.

By using this new heating concept, wherein a preheating phase uses two low frequency heating cycles separated by a time delay and wherein the particular frequencies and times discussed above are employed, gear teeth can be uniformly heated on their outwardly facing surfaces without through heating the gear teeth which can create brittle teeth upon hardening or without producing soft portions due to lower temperatures before quench hardening. Since the thin layer of high temperature metal immediately adjacent the surface of the teeth is immediately quench hardened, there is no time for extensive grain growth and high compressive forces are created in the teeth surfaces. These high compressive forces imparted to the teeth surfaces are beneficial in the overall operation of the gear teeth.

The above-identified new method of hardening the outer surface of the gear teeth of a gear was performed by first moving the gear into an induction heating coil for audio frequency heating during two preheating cycles. The preheated gear with the desired temporary temperature profile was then rapidly shifted axially into a second induction heating coil for final heating of the outer surfaces of the gear teeth by a high radio frequency power supply before the unstable heat profile dissipated. This high radio frequency was generally above about 200 KHz. The radio frequency induction heating coil or inductor included an integral quench concept wherein quenching liquid was immediately directed through the inner surface of the coil or inductor against the heated surfaces of the gear teeth for immediate and rapid liquid quench hardening. The surfaces were quench hardened and then removed from the second inductor or coil. The two axially spaced coils had an axial length exceeding the axial length of the gear so that the total gear was heated at one time during both preheating by the low frequency power source below about 10 KHz and final heating by the high frequency power source exceeding about 100–200 KHz. It was essential that the high frequency heating take place immediately and rapidly over the total surface of the gear teeth to be hardened to avoid stabilization of the radically created heat profile within the individual teeth. This required a heating time of less than about 1.0 seconds. The time between audio frequency heating and final heating had to be very rapid and was substantially less than 1.0 seconds. Indeed, the shift time delay was, in practice, about 0.4 seconds as was the final heating cycle by the high radio frequency energized inductor. In view of these time and heating requirements to provide the individual teeth with a unique temperature or heat profile immediately before liquid quench hardening, the power supply for the radio frequency inductor or coil had to have a substantially high power rating to produce the desired rapid induction of energy into the surface of the gear so rapid heating could occur to allow immediate quench hardening without dissipation of the heat energy from the teeth surfaces toward the interior portion of the teeth and into the root section or area of the gear. In practice, the power supply for the radio frequency inductor would exceed substantially 300 Kilowatts. Indeed, even the power supply for the audio frequency inductor during preheating generally exceeded 200 Kilowatts. As can be seen, high power densities were required due to the short time and large areas of the gear teeth being heated, first by two preheating cycles by the audio frequency power supply and then with a final heating cycle by the radio frequency power supply. In view of these conditions, the equipment for performing the radically new and extremely beneficial invention of the prior application finally making induction heating and quench hardening of teeth commercially feasible, were expensive and somewhat limited as to the size of the gear which could be processed in accordance with this novel induction heating process.

THE PRESENT INVENTION

In accordance with the present invention, the advantageous concept of high power density preheating at low frequency, rapid final heating of high power density and then an immediate quench hardening for the outer toothed surface of gears is accomplished without requiring large and expensive power supplies. As is well known, as the rating of a power supply increases, especially an oscillator as used for radio frequency above 100–200 KHz, the cost of the power supply drastically increases. For this reason, inductively heating gear teeth in accordance with the prior disclosed invention was expensive and sometimes impractical when the gears to be hardened were large, either in diameter or in axial length or height. Use of lower power densities diminished the profile capturing feature of the new gear hardening method which was usable for high production processing of gears. This problem of requiring expensive power supplies is substantially overcome by the present invention.

In accordance with the present invention, there is provided a method of progressively hardening an elongated workpiece having an outer generally cylindrical convoluted surface, such as the outer toothed surface of a gear, which surface is concentric with a central axis. The method comprises the steps of: providing closely spaced first and second induction heating coils with workpiece receiving openings generally concentric with the axis of the workpiece; energizing the first coil or inductor with a low audio frequency; energizing the second inductor or coil with a high radio frequency; causing relative axial and progressive motion between the workpiece and the first and second induction heating coils in a direction wherein the workpiece enters from the first coil and exits from the second coil whereby the outer cylindrical surface is progressively first preheated by the first coil and then immediately final heated by the second coil; and, then immediately quenching the cylindrical convoluted surface as it is passed from the second coil. In this manner, a very small band of the outer surface is progressively preheated to heat the root area of the gear and immediately thereafter a small band is progressively final heated to heat the outer surfaces of teeth. The preheating and final heating is accomplished in rapid succession to obtain the heating profile discussed in accordance with the prior invention where at the time of quenching the core of the gear is cool, the root area and teeth bodies warm and the surfaces above the quench hardening temperature. In a progressive manner, the preheated and final heated portions of the workpiece are immediately and rapidly quench hardened by liquid to capture the unstable heat profile into a fixed hardness pattern. In accordance with another aspect of the invention, the rate of movement of the workpiece with respect to the two induction heating coils is such as to produce a delay between the preheating of the first coil and the final heating of the second coil of less than about 1.0 seconds. In accordance with the preferred embodiment, the gear moves through the coils or inductors at a rate to produce a delay between the preheating and final heating of about 0.4 seconds.

In accordance with still a further aspect of the present invention, the gear is rotated about its central axis as it progresses through the two induction heating coils for progressively preheating and then final heating the outer cylindrical toothed surface of the gear. In accordance with another aspect of the invention, another inductor using low frequency is provided so that the gear can progressively move through three axially aligned, closely spaced induction heating inductors or coils. The first inductor is used for a first preheat cycle, as explained in accordance with the prior invention. Thereafter, the second inductor or coil is employed for a second preheat cycle which is followed by a final progressive heating preparatory to quench hardening at the exit end of the third induction heating coil or inductor. At least the second preheat and final heat are performed on the same gear at the same time in a progressive fashion.

In accordance with the invention, the low frequency is between about 1–50 KHz, preferably below 20 KHz. The high radio frequency is greater than 100 KHz, preferably in excess of 200 KHz.

By employing the present invention, the height or width of the inductors determines generally the size of the band of heating progressively along the outer surface of the gear. A high power density is required in the present invention and in the prior invention. This high density at the teeth is created by reducing the areas of the heating bands, instead of increasing the rating of the power supplies. Consequently, the power density envisioned by the prior invention is employed in the actual short time cycle, high density heating. The total gear surface is not surrounded by an inductor during the first and second preheating cycle and then during the final heating cycle as done by us before. By utilizing the progressive heating concept, the thicknesses of the heating bands and, thus, the heights of the inductors are not dependent upon the axial height of the gear being processed in accordance with the present invention.

In accordance with another aspect of the present invention, there is provided an apparatus for performing the method defined above. In accordance with this aspect of the invention, the apparatus includes first and second induction heating coils; means for mounting these coils in closely spaced relationship with the opening generally concentric with the axis of the gear; means for energizing the second coil with a high radio frequency; means for causing a relative axial and progressive motion inbetween the workpiece and the first and second coils in a direction whereby the workpiece enters from the first coil and exits from the second coil so that the cylindrical surface of the workpiece is progressively first preheated by the first coil and then immediately final heated by the second coil; and, means for immediately liquid quenching the cylindrical surface as it passes from the second coil to create hard outer surfaces for the circumferentially arranged teeth by hardening the teeth surfaces before the heat profile in the teeth stabilizes. The surface hardening occurs while the unique root portions between the teeth and the band in the core of the gear including these root portions is at a relatively high temperature substantially below the critical temperature, the core is at a low temperature and the teeth surfaces are at a temperature exceeding the quench hardening temperature of the material forming the gears. This unique, unstable heat profile is created by the high power density as in the prior invention. This high power density results from the reduced size of the heating bands for preheating and final heating. Heating is done progressively and simultaneously on the gear surface.

The primary object of the present invention is the provision of a method and apparatus for hardening the outer cylindrical surface of a steel gear-like workpiece adapted to be rotated about a given axis, which method and apparatus produce a uniform hardness pattern in the teeth surfaces of the gear at a rapid rate using relatively common induction heating equipment, such as circular inductors and high frequency power supplies.

Another object of the present invention is the provision of a method and apparatus, as defined above, which method and apparatus use a scanning process whereby the outer toothed surface is progressively preheated, final heated and then liquid quench hardened simultaneously in a single pass.

Yet another object of the present invention is the provision of a method and apparatus as defined above, which method and apparatus allows the use of lower rated power supplies for performing dual frequency heating and then quench hardening of the outer surface of a cylindrical workpiece, such as the surfaces of teeth on a gear.

Still a further object of the present invention is the provision of a method and apparatus, as defined above, which method and apparatus employs two or three axially aligned, closely spaced inductors adapted to first preheat a cylindrical surface of a gear progressively and then progressively final heat the cylindrical surface of the gear preparatory to an immediate, progressive quench hardening of the gear.

Another object of the present invention is the provision of a method and apparatus, as defined above, which method and apparatus employs dual frequency heating, short heating time, high power density and reduced size for the power supply by employing a progressive heating and quenching procedure.

These and other objects and advantages will become apparent from the following description taken together with the accompanying drawings discussed in the next section.

Preferred Embodiment

Figure 1:
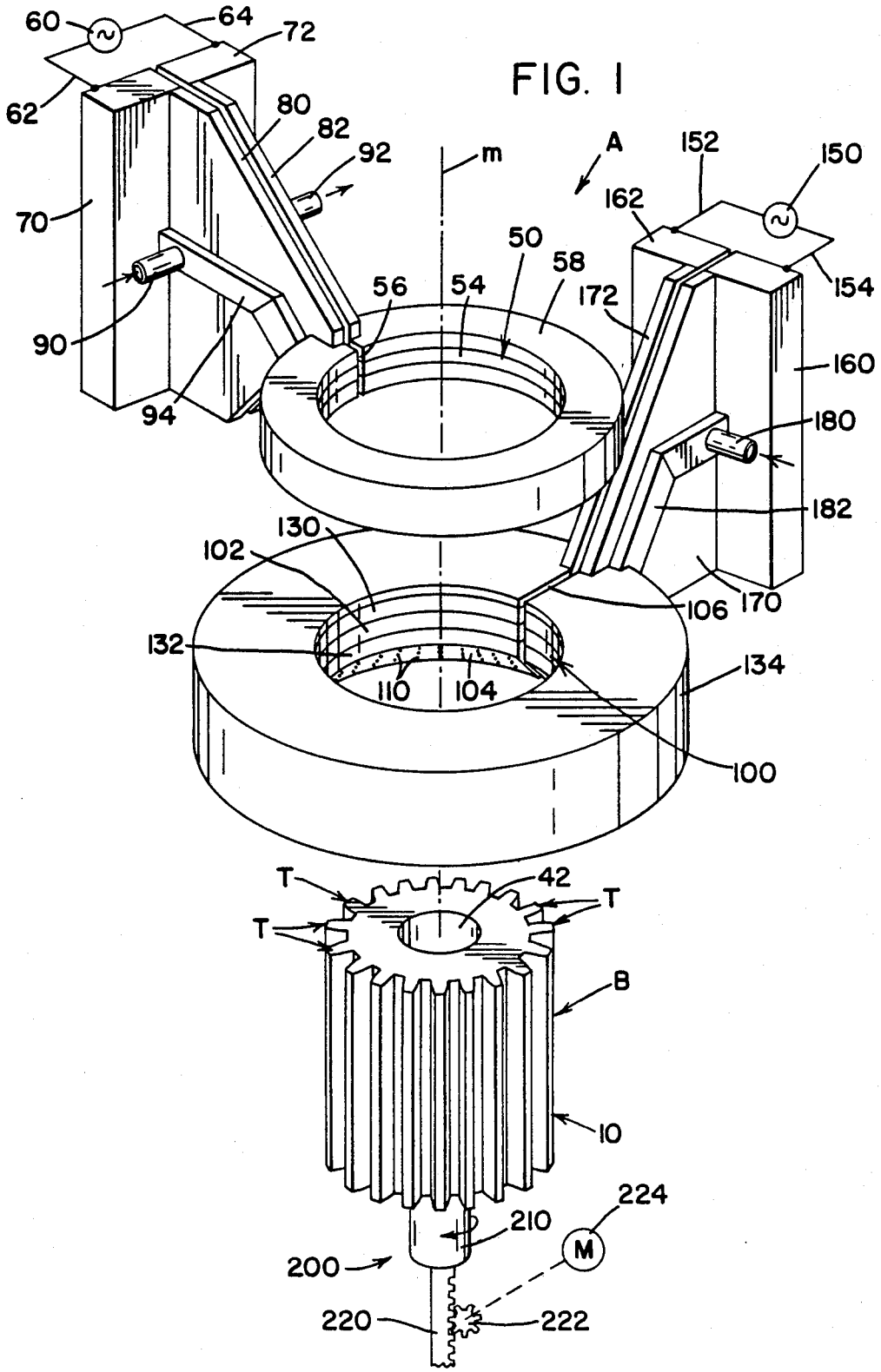
FIG. 1 is a pictorial view illustrating the preferred embodiment of the present invention.
Figure 2:
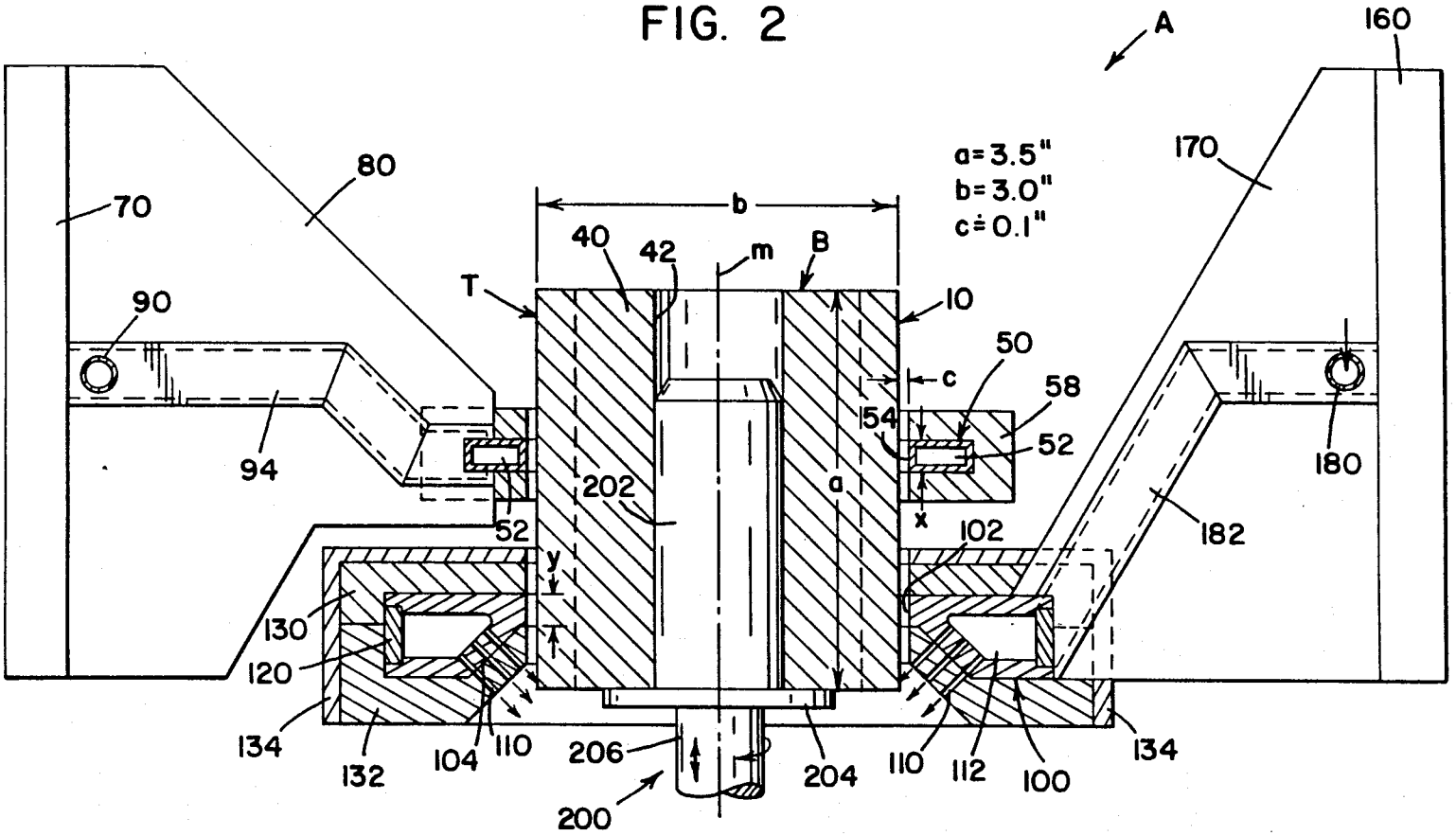
FIG. 2 is an enlarged, partially cross-sectional view showing the preferred embodiment of the present invention.

Referring now to the drawings wherein the showings are for the purpose of illustrating a preferred embodiment of the invention and not for the purpose of limiting same, FIGS. 1 and 2 show an apparatus A for progressively scan hardening outer generally cylindrical surface 10 of a cylindrical workpiece, in accordance with the invention. A gear B is rotatably mounted about the central axis m. Gear B includes a plurality of radially extending teeth T, best shown in FIG. 5, which teeth can be oriented at an angle to axis m or, in accordance with the illustrated embodiment, they can be aligned with the axis of rotation. Each tooth includes a top 20, oppositely facing bearing surfaces 22, 24 and interconnecting root area 30 all formed from core 40 of gear B. A standard central opening 42 is provided in the core of the gear. Various other gear structures and cylindrical workpieces with convoluted surfaces, such as chain sprockets, could be processed by apparatus A operated in accordance with the present invention to progressively harden outer cylindrical toothed surface 10. Of course, the cylindrical surface could be an internal surface, such as an internal gear. Although the invention is described as being applicable to cylindrical surfaces, it is primarily and specifically an improvement in hardening gears and was developed for this purpose to incorporate the advantages of heat profiling obtainable by using dual frequencies as defined in our prior application. In accordance with the present invention, the outer surface 10 is hardened progressively; therefore, the length A of gear B can have a substantial value. In the illustrated embodiment, length A is 3.5 inches while diameter B is 3.0 inches. Air gap C, in the illustrated embodiment, is approximately 0.1 inches. A gear having this size would require power supplies, especially the radio frequency oscillator, of over 300 Kilowatts for adequately preheating and then final heating to produce the internal heat or temperature profile immediately prior to quench hardening as obtainable in accordance with the specific invention of our prior application. By using the present invention, large gears, either large in diameter or large in length or height, can be processed while employing relatively inexpensive, lower power rated audio frequency and radio frequency power supplies of the inverter or oscillator type, respectively. Opening 42 defines the inner boundary of core 40. The outer boundary of the core is not well defined; however, it generally includes root areas 30. A band at this outer boundary is preheated by audio frequency, preferably a two stage or dual cycle audio frequency heating. This produces a band of elevated temperature at the outer boundary of core 40. Consequently, the root areas 30 have a heat barrier between the outer surfaces and core 40. Subsequent radio frequency heating of the outer surface 10 including teeth T will produce a skin effect heating along the outer exposed surfaces of the teeth to a depth sufficiently controlled by the frequency of the final radio frequency heating. The heat barrier in the outer boundary of core 40 prevents immediate reduction in the surface temperature which remains, for a short time, above the critical quench hardening temperature. Immediate quench hardening will provide high compression hardening of the surfaces. This hardening will exist in the exposed surfaces through the root areas due to the prior established heat or temperature profile wherein heat is retained in the root area subsequent to audio frequency final heating. All of these heat profile concepts are obtainable in a scan hardening process utilizing apparatus A.

Referring now in more detail to apparatus A, the radio frequency inductor or coil 50 has an inner coolant passage 52 and an inwardly facing, cylindrical surface 54 spaced outwardly from surface 10 to define air gap c. The inductor has a preselected width x and is separated at gap 56 in accordance with standard induction heating practice. A U-shaped flux concentrator 58, formed of standard high permeability material, such as Ferrocon, is secured around inductor 50 to concentrate the magnetic flux at surface 54 in a narrow band on the outer cylindrical surface 10 of gear B. Audio frequency power supply 60 is preferably a solid state inverter having an output between 1–10 KHz. In accordance with the invention, inductor 50 is referred to as an audio frequency inductor; however, the frequency can be slightly above the audio frequency level as long as it is below approximately 50 KHz. Inductor 50 is adapted to heat, by a high power density, a relatively narrow band having a length approximately equal to width x in surface 10 at a frequency which will cause heating of the previously discussed band in core 40 at root areas 30. In this manner, low frequency heating forces a high level of energy at the bottom of the teeth caused by induced currents circulating around the core area to produce a selected heated band in this area. This heating is below the quench hardening temperature and produces a heat barrier for the surfaces to be hardened. Heating of the teeth T also occurs by inductor 50; however, the teeth will radiate energy from the outer surfaces to allow the heated band in the core adjacent the root areas to be substantially higher in temperature than the body of the teeth after the audio frequency heating occurs and prior to final radio frequency skin heating by the axially aligned lower inductor or coil 100 to be described in more detail later.

Power supply 60 includes leads 62, 64 adapted to be connected with standard fishtails 70, 72 integrally connected with outwardly extending bars 80, 82, respectively. Coolant inlet 90 and outlet 92 forms a liquid circuit including an outer conduit 94 on bar 80 and another similar conduit on bar 82, which conduit is not shown. Coolant in this circulation system passes through inner or internal coolant passage 52 of inductor 50 to dissipate heat generated during scan heating of gear B by inductor 50.

Coil or inductor 50 is concentric with axis m and is axially aligned above the lower radio frequency inductor or coil 100 having an inwardly facing cylindrical surface 102 with a gear facing width y and a downwardly conical facing surface 104. Gap 106 forms the inductor into a conductive path to conduct radio frequency current around gear B at a closely spaced position with respect to inductor 50 during the scan hardening process. In inductor 100, a number of inwardly facing quench liquid holes 110 produce inwardly directed high velocity jets of quenching liquid, as indicated by the arrows in FIGS. 2 and 4. Quenching holes 110 receive quenching liquid from an inward, annular passage 112 machined into inductor 100 and closed by an outer cover or band 120. An appropriate flux concentrating structure surrounds inductor 100 and leaves only inwardly facing cylindrical surface 102 exposed to gear B. This flux concentrating structure is formed from a high permeability cast material, such as Ferracon and includes an upper cap 130 and a lower cap 132. These caps are held together by a non-magnetic retainer, such as cup 134.

An appropriate radio frequency power supply, such as oscillator 150, causes radio frequency current flow through inductor 100. The radio frequency current has a frequency between about 100–450 KHz and preferably a frequency above 200 KHz. Leads 152, 154 are connected to standard fishtails 160, 162 having integral, inwardly directed bars 170, 172. A quench liquid inlet 180 is connected by conduit 182 to the inner quench liquid passage 112 to provide pressurized coolant for the purpose of generating the inwardly facing jets of quenching liquid immediately after outer surface 10 of gear B is final heated.

To perform the invention, gear B is to be progressively moved along axis m with respect to inductors 50, 100 and also rotated during the progressive preheating, final heating and quench hardening. A variety of mechanisms could be employed for this mechanism movement; therefore, transfer mechanism 200 is schematically illustrated as including a rotatable mandrel 202 with a lower collar 204 for supporting gear B by engagement and alignment with opening 42. Below the mandrel is a shaft 206 rotatable by motor 210 while it is being moved progressively in a vertical direction along axis m by an appropriate mechanism, such as schematically illustrated rack 220, pinion 222 and selectively operated motor 224. As the gear is moved downwardly through inductors 50, 100, the gear is first preheated by audio frequency inductor 50, then final heated by high audio frequency exceeding about 100 KHz and then immediately thereafter liquid quench hardened by liquid directed through the many openings or holes 110 in radio frequency inductor 100.

Figure 3:
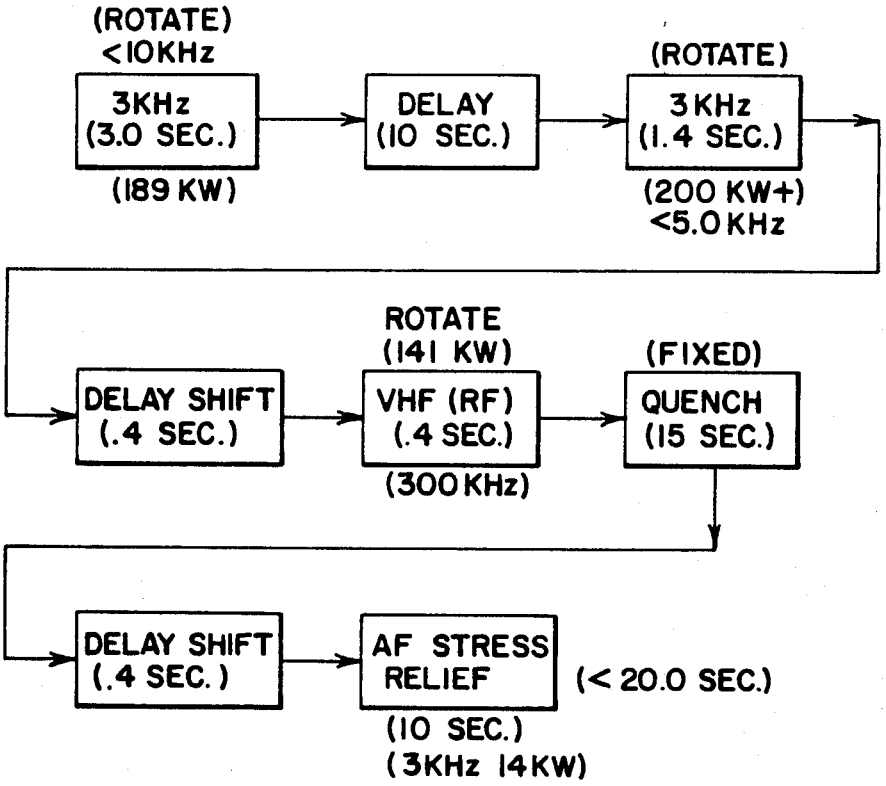
FIG. 3 is a block diagram illustrating the heating process employed for creating the desired heat or temperature profile for quench hardening and the quench hardening procedure employed in the prior application and used in the present invention.
Figure 5:
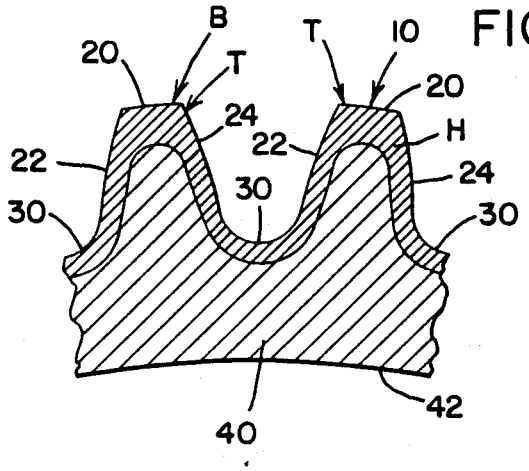
FIG. 5 is a cross-sectional, enlarged partial view illustrating the hardness pattern obtained when using the present invention.

Referring now to FIG. 3, the process for hardening the outer surface 10 of gear B to produce the desired hardness pattern H, shown in FIG. 5 and extending around the surfaces of teeth T, is set forth in block diagram form. This process was developed for a stationary heating operation, as defined in our prior application. In accordance with that invention, the gear is rotated and heated with an audio frequency current with a frequency of less than about 10 KHz. This first preheat cycle is performed in about 3.0 seconds with a 200 Kilowatt power supply. After a 10 second delay, the heat created in the teeth and in the root area of core 40 by relatively low frequency heating current is allowed to stabilize in a heat profile generally extending around core 40 at root areas 30. Thereafter, a second preheat cycle occurs, again at a low frequency for a short time, such as 1.4 seconds. This again forces heat energy into root areas 30 and into the bodies of the teeth T. Dissipation from the surfaces of the teeth allows this second preheating cycle to maintain the band of high temperature around the root areas so that the bulk of the core is cool, the band of the core at root areas 30 is hot, and the teeth bodies are warm. This preselected heat or temperature profile is dynamic and can not be retained for any substantial length of time. It is dynamic. For that reason, after a very short delay necessary for shifting into high radio frequency final heating, final heating is accomplished by high radio frequency in the neighborhood of 300 KHz with the high power exceeding about 100 Kilowatts. This heating occurs for a short time and is immediately followed by the liquid quenching through the radio frequency final heating inductor. In accordance with the prior application, quenching is fixed to allow better penetration into the gear teeth themselves; however, the gear could be rotated during quenching. In accordance with the method illustrated in FIG. 3, the gear could be again heated by audio frequency for stress relieving.

In accordance with the preferred embodiment of the present invention, only two coils 50, 100 are employed. Progressive heating does occur simultaneously. The invention is primarily directed toward preheating, short delay, and then final heating in a progressive manner to obtain the desired heat or temperature profile and immediate liquid quench hardening in a progressive manner. As will be hereinafter described, two inductors can provide dual preheating and also final stress relieving, if required.

Figure 4:
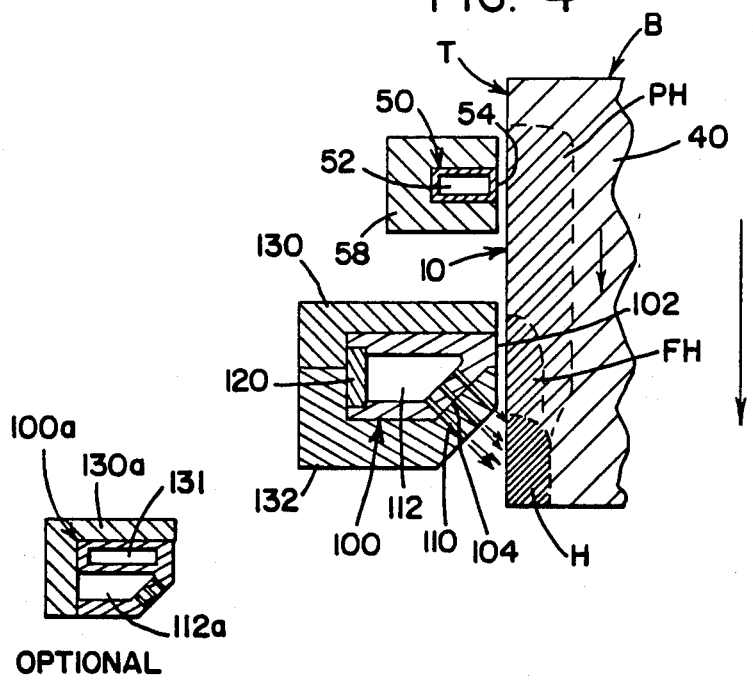
FIG. 4 is an enlarged, partially cross-sectioned view showing the progressive preheating, final heating and quench hardening in accordance with the present invention.

The progressive heating operation is illustrated in FIG. 4 wherein gear B is progressively moved downwardly or scanned, as indicated by the arrow at the right, so that a preheating profile PH is created adjacent teeth T, as the teeth pass by inductor 50. A final heating profile PH occurs when the previously preheated portions of gear B pass by surface 102 of inductor 100. With this final heating, the surfaces of teeth T are above the critical temperature for subsequent quench hardening of the surfaces. This quench hardening occurs with liquid from passage 112 directed inwardly and downwardly against the final heated outer surfaces of the gear teeth. This quenching produces the hardness pattern H around the surface of the teeth, as schematically illustrated in FIG. 5.

Figure 6:
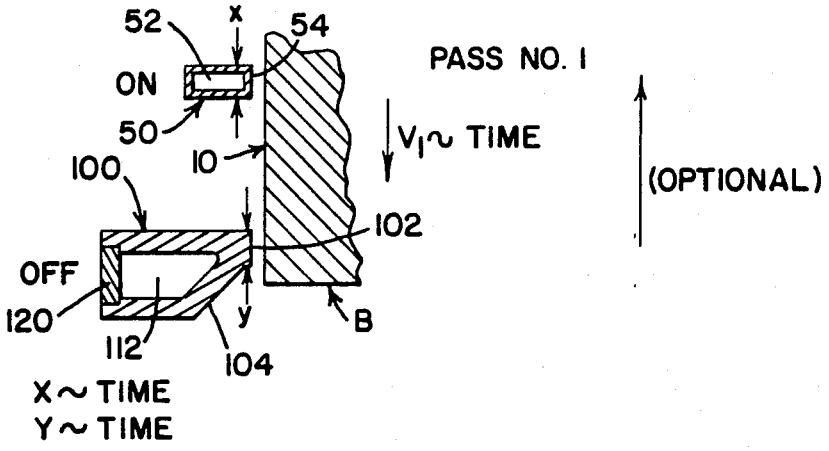
FIGS. 6 and 7 are partial cross-sectional views showing dimensional and operational characteristics of the preferred embodiment of the present invention.
Figure 7:
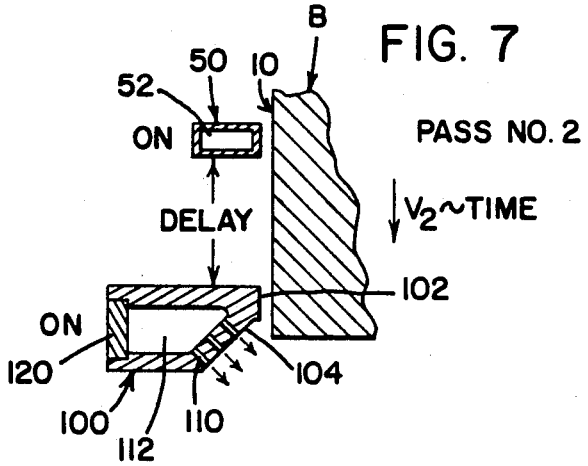

In FIG. 6, the arrangement for accomplishing the dual preheating is illustrated as an optional process wherein gear B can be moved upwardly as indicated by the arrow at the right hand side of FIG. 6. During this upward scanning movement, only audio frequency inductor 50 is energized. This inductor preheats the outer surface 10 of gear B as illustrated in the first block of FIG. 3. After a slight delay, the gear is then moved downwardly in accordance with the arrow adjacent gear B in FIG. 6. At that time, the velocity is controlled to produce a preselected time that teeth T are subjected to the audio frequency preheating and the final heating by very high radio frequency. Technically, radio frequency occurs above about 18 KHz–20 KHz; therefore, the present invention anticipates a very high radio frequency exceeding about 100 KHz to produce a skin effect final heating of the gear teeth surfaces so that these surfaces can be quench hardened to produce the desired hardness pattern H without through heating and hardening of the teeth. As the velocity increases, the heating band width determined by the thickness of the inductor determines the actual time of preheating and final heating. Further, the spacing between the two inductors, as illustrated in FIG. 7, determines the delay between preheating and final heating. This is the delay shift of approximately 0.4 seconds required in accordance with the illustrated embodiment, as set forth in FIG. 3. Immediately after final heating, quench hardening occurs as illustrated in FIG. 7.

Figure 8:
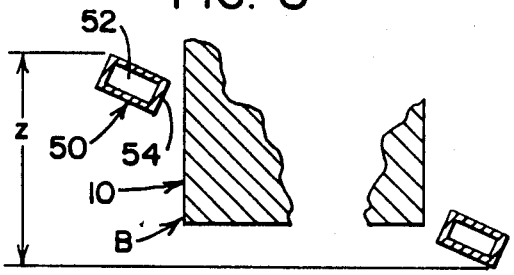
FIG. 8 is a partial view showing, in cross-section, a modification of the preferred embodiment of the present invention.

By adjusting the velocity and the width of the inwardly facing surfaces for inductors 50, 100, the band width for preheating and final heating will determine the amount of energy being introduced into the teeth during preheating and final heating. As the scan velocity increases, the power requirement increases to give the desired heating. As the width increases, the required power increases also. By providing the progressive heating, these power requirements can be controlled by the parameter of the progressive heating method to allow relatively inexpensive, low power rated power supplies for performing the preheating and final heating processes. Further, it is not necessary to provide power supplies of different ratings for different gears being processed. Thus, the size of the gear does not determine the power rating of apparatus A. The velocity of the progressive hardening, the width of the inductors, the spacing of the inductors all are parameters which can be adjusted to produce the high power density for the heating operation at very small bands so that the input power supplies can be relatively small while still obtaining the high power densities. High power density accomplishes the desired dynamic heat or temperature profile immediately prior to quench hardening. This is a substantial advance in the art which allows rapid processing of gear teeth in an inexpensive apparatus A to obtain results comparable and even better than carburizing processes heretofore employed. Of course, carburization could be employed in the present invention to treat the surfaces of the teeth for the purpose of controlling the hardening characteristics of these surfaces after quench hardening. As illustrated in FIG. 8, inductor 50 can be placed at an angle to axis m so that the band width z of the preheating process can be increased without changing the dimensions of the inductor 50.

Figure 9:
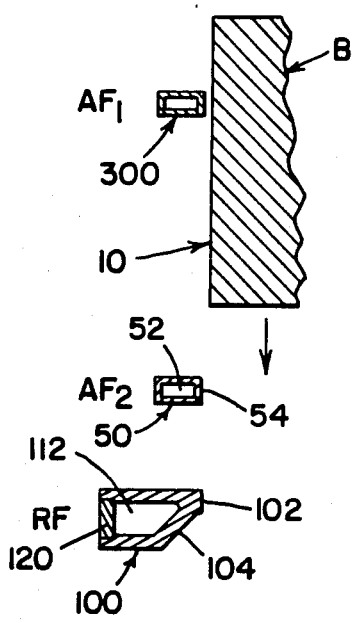
FIGS. 9–12 are views similar to FIGS. 6 and 7 showing modifications of the preferred embodiment of the present invention.
Figure 10:
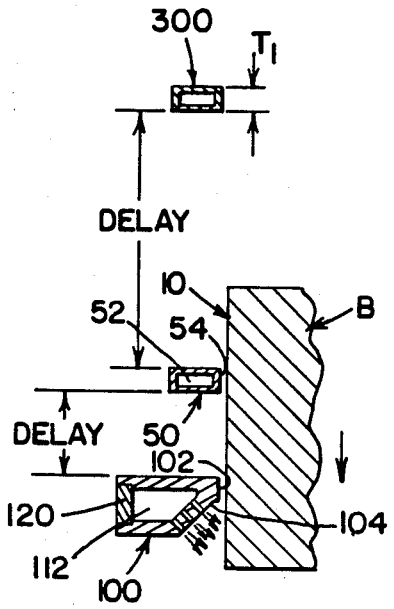
Figure 11:
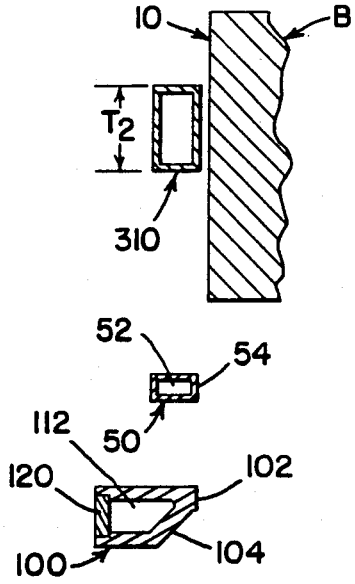
Figure 12:
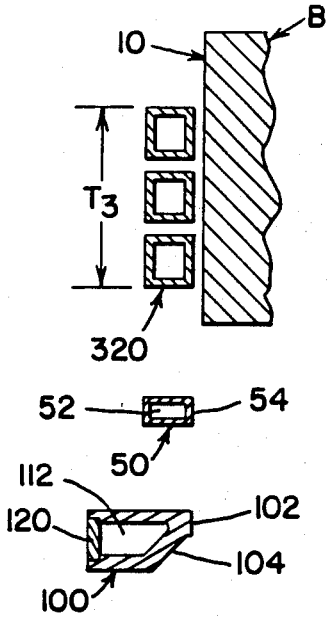
Figure 13:
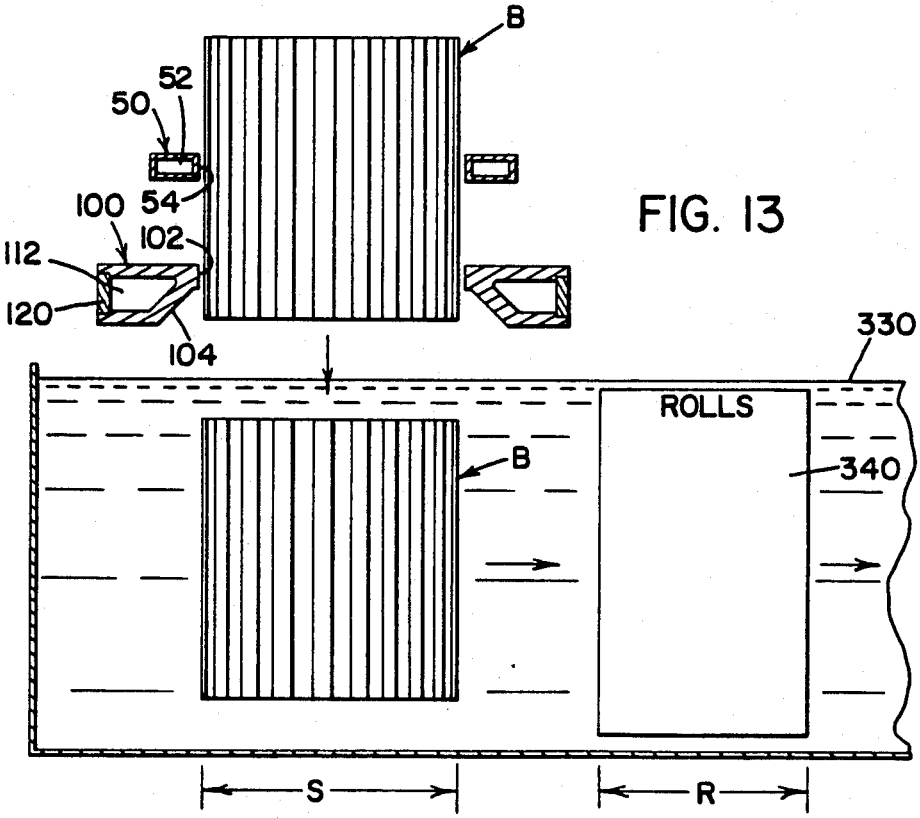
FIG. 13 is a schematic view showing use of the preferred embodiment of the present invention in an austrolling process; and, FIG. 14 is an expanded view of the austrolling process illustrated in FIG. 13 employing the preferred embodiment of the present invention.

Referring now to FIGS. 9 and 10, instead of obtaining the original preheating by audio frequency inductor 50, second inductor 300 can be positioned vertically above inductors 50, 100. In this arrangement, audio frequency $AF_1$ energizes inductor or coil 300 to cause the initial preheating of a moving band in progressively scanned gear B. This initial preheating is illustrated in the first block of the block diagram in FIG. 3. Inductor 300 is spaced above inductor 50 which is powered by audio frequency $AF_2$. Inductor 100 is powered by the high radio frequency as previously described. As gear B progressively moves downwardly, inductor 300 first preheats the gear teeth on surface 10. The delay, which is approximately 10 seconds in the preferred embodiment of the invention, occurs between the heating by inductor 300 and the heating by the upper audio frequency inductor 50. This delay is obtained by a combination of the spacing between inductors 300, 50 and the progressive or scan velocity of gear B. Time $T_1$ is a time for the initial preheating which, in practice, is 3.0 seconds. This time is determined by the width of the band which, in turn, is predicated by the height of the inductor or its effective height, as explained with respect to FIG. 8. The spacing between inductors 50, 100 is the very short delay shift in the preferred embodiment of the invention and is approximately 0.4 seconds. It is less than about 1.0 seconds. The width or height of inductor 50 determines the time of the second preheating cycle by controlling the heated band progressively along surface 10. As illustrated in the preferred embodiment, this time is about 1.4 seconds. It is possible that gear B is initially preheated by inductor 300 by passing inductor 300 before the gear actually enters the lower set of inductors. In this manner, the initial velocity of gear B can be different than the progressive heating velocity as the gear moves through the lower set of inductors. These are all modifications of the preferred embodiment of the present invention which primarily relates to the use of the lower set of two inductors for the purpose of progressively heating with or without the advantage of the original preheating, which is employed in the preferred embodiment of the invention. To increase the heating time for the original preheating, inductor 300 could have a longer length, as shown in FIG. 11, where inductor 310 has a length to create a time $T_2$. In a like manner, a multiturn preheating inductor could be employed, as illustrated in FIG. 12. In this figure, multiturn inductor 320 creates an initial preheating time $T_3$. Other variations of this concept are clearly within the ordinary skill of the field.

Figure 14:
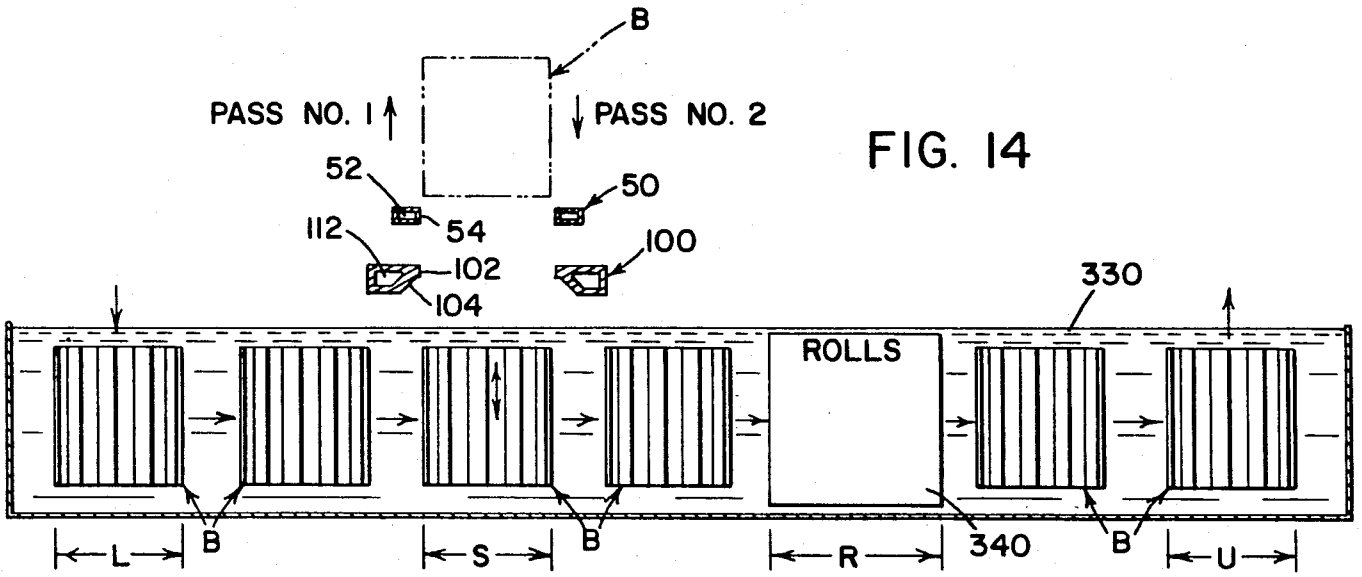

The present invention has been developed for the purposes of hardening gear teeth to produce the uniform hardness patterns schematically represented as pattern H in FIG. 5. Another use of this particular method is in the newly developed austrolling concept disclosed in U.S. Patent No. 4,373,973. In practicing this particular method of forming the outer teeth or other similar surface of a workpiece, gears B have their outer surfaces 10 raised to a temperature above the critical hardening temperature A3. This is accomplished by employing the present invention. In FIG. 14, a bath 330 of salt or other appropriate heat treating material is maintained at a temperature just above the metastable austentic temperature of the steel forming the teeth of gear B. In practice, this temperature is generally in the neighborhood of 400° F.–500° Gears B, in the schematically illustrated system and method, are first loaded vertically downwardly into the bath at station L. The gear travels within the bath until the gear has stabilized to the temperature of bath 330. After the temperature has been stabilized, gear B at station S is moved upwardly for an initial pass while inductor 50 is energized. This produces the initial preheating to cause temperature concentration in the root areas 30 of gear B. Thereafter, gear B is progressed vertically downwardly through inductors 50, 100 for the purpose of progressively first preheating and then final heating as previously explained. The gear is thus selectively heated in the teeth surfaces to a temperature above the quench hardening temperature. The gear is immediately plunged into bath 330 for quench hardening. In this manner, the surface is hardened, but is maintained just above the metastable austentic temperature. Thereafter, the gear with the outer surfaces held at the bath temperature is transferred into a rolling station where the gears are rolled to deform the gear teeth into the exact contour while maintaining the surfaces at the temperature of the bath 330. This rolling operation is accomplished by standard rolls, schematically illustrated as block 340. After the gear has been rolled to deform the outer surface into the desired contour and shape, gear B is moved to unloading station U where it is removed for cooling to ambient temperature. This process provides an accurate gear surface without the necessity for subsequent grinding after hardness. As can be seen, the present invention utilizing two closely spaced inductors 50, 100 can be employed for this unique austrolling concept without departing from the intended spirit and scope of the invention.

It has been found that gears processed in accordance with the present invention utilizing a single pass through inductors 50, 100 produce a compressive stress over the total surface of gear teeth T. The stress, at the base diameter and at the 45° point is well over 100,000 lbs/in.$^2$. This measurement has been taken by cutting the teeth and measuring expansion after the teeth have been separated in accordance with standard practice.

Referring again to FIG. 4, an optional structure for inductor 100 is shown as inductor 100*a* which includes a coolant passage 131 as well as the quench liquid passage 112*a*.

By using the present invention, only a short axial distance of the gear is heated at a time. Consequently, the energy content of the part at any given time is substantially lower than static heating in successive cycles of different frequencies. This provides improved energy control, less energy to remove by quenching, less thermal generated part movement, and less distortion. There are shallower transition zones under the hardened case; therefore, a higher compressive stress level is created. Higher hardness on the surface with higher hardness extending into the near surface layer improves surface performance in pitting and rolling/sliding control fatigue. Further, the heating can be varied along the length of the part to suit geometric variations.

Having thus described the invention, it is hereby claimed:

1. Apparatus for progressively hardening an elongated workpiece having a generally cylindrical surface concentric with a central axis while axially elongated with respect thereto, said apparatus comprising induction coil means for heating said cylindrical surface by induction;

means for energizing said induction coil means with a low frequency;

means for causing relative and progressive motion in an axial direction between said cylindrical surface and said induction coil means energized at said low frequency to initially and progressively preheat said cylindrical surface relative to a first band at a temperature below a quench hardening temperature of the workpiece while relative motion in the axial direction occurs between said cylindrical surface and said induction coil means;

means for energizing said induction coil means at a high frequency;

said means for causing relative and progressive motion operable to cause relative and progressive motion in an axial direction between said induction coil means and said cylindrical surface immediately after said cylindrical surface has been progressively preheated and while said induction coil means is at high frequency to cause final progressive heating of said cylindrical surface relative to a second band at a temperature greater than or equal to said quench hardening temperatures while relative motion in the axial direction occurs between said cylindrical surface and said induction coil means; and means for progressively quenching said cylindrical surface as it passes from said induction heating coil means after being finally heated.

2. Apparatus of claim 1 wherein said induction coil means comprise a first and second induction heating coil spaced from one another, said first coil operated by said low frequency means and said second coil operated by said high frequency means.

3. A method of hardening the outer cylindrical gear teeth surface of a gear having a core and a preselected axial length parallel to a central concentric axis, said teeth surface including teeth and connecting roots and said surface having a quench hardening temperature, said method comprising the steps of:

a. progressively preheating while moving at a given axial velocity, said surface relative to a first band, said preheating being sufficient to heat said roots to a temperature greater than the temperature of said core but less than said quench hardening temperature;

b. progressively final heating while moving at a given axial velocity, said surface relative to a second band, said final heating being to heat said preheated surface to a final temperature at said surface greater than or equal to said quench hardening temperature; and c. immediately and progressively quenching said surface after final heating thereof.

* * * * *